US009212645B2

(12) United States Patent
Naruse et al.

(10) Patent No.: US 9,212,645 B2
(45) Date of Patent: Dec. 15, 2015

(54) INTERNAL COMBUSTION ENGINE IGNITION DEVICE

(71) Applicant: Mitsubishi Electric Corporation, Chiyoda-ku, Tokyo (JP)

(72) Inventors: Yusuke Naruse, Chiyoda-ku (JP); Kimihiko Tanaya, Chiyoda-ku (JP); Takeshi Shimizu, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 162 days.

(21) Appl. No.: 14/196,756

(22) Filed: Mar. 4, 2014

(65) Prior Publication Data

US 2015/0116890 A1 Apr. 30, 2015

(30) Foreign Application Priority Data

Oct. 28, 2013 (JP) ..... 2013-222938

(51) Int. Cl.

| | |
|---|---|
| ***F02P 17/00*** | (2006.01) |
| ***F02P 1/08*** | (2006.01) |
| ***F02P 3/04*** | (2006.01) |
| ***F02P 9/00*** | (2006.01) |
| *F02P 17/12* | (2006.01) |

(52) U.S. Cl.

CPC . *F02P 1/083* (2013.01); *F02P 3/04* (2013.01); *F02P 9/002* (2013.01); *F02P 2017/121* (2013.01); *F02P 2017/125* (2013.01)

(58) Field of Classification Search

CPC ..... G01R 31/3658; G01R 31/007
USPC ..... 324/380, 388
See application file for complete search history.

(56) References Cited

U.S. PATENT DOCUMENTS

| | | | | |
|---|---|---|---|---|
| 5,781,012 | A * | 7/1998 | Yasuda | F02P 17/12 324/388 |
| 6,075,366 | A * | 6/2000 | Yasuda | F02P 3/093 324/380 |
| 6,700,470 | B2 * | 3/2004 | Butler, Jr. | F02P 3/02 29/602.1 |
| 2007/0137628 | A1 * | 6/2007 | Naruse | F02P 17/12 123/618 |
| 2008/0092865 | A1 * | 4/2008 | Aida | F02P 3/0554 123/594 |
| 2008/0135017 | A1 * | 6/2008 | Naruse | G01L 23/255 123/406.12 |
| 2009/0173315 | A1 * | 7/2009 | Inada | F02P 17/12 123/406.26 |
| 2009/0183719 | A1 * | 7/2009 | Aida | F02P 17/12 123/644 |
| 2010/0122689 | A1 | 5/2010 | Tanaya | |

FOREIGN PATENT DOCUMENTS

JP 2010-121553 A 6/2010

* cited by examiner

*Primary Examiner* — Dharti Patel
(74) *Attorney, Agent, or Firm* — Sughrue Mion, PLLC

(57) ABSTRACT

There is provided an internal combustion engine ignition device which comprises a switching element for causing or interrupting flow of a current through a primary coil of an ignition coil; a secondary current detection circuit connected to a secondary coil for detecting a secondary current flowing at the time of ignition; an ion current detection circuit for detecting an ion current generated after the ignition; and an energy consumption circuit which is activated based on an output signal from the secondary current detection circuit that is output when the secondary current exceeds a predetermined threshold value, to constitute a circuit for discharging energy stored in the ignition coil.

7 Claims, 4 Drawing Sheets

INTERNAL COMBUSTION ENGINE IGNITION DEVICE

BACKGROUND OF THE INVENTION

1. Field of the Invention

The present invention relates to an internal combustion engine ignition device to be mounted, for example, in a vehicle, and in more detail, to an internal combustion engine ignition device that generates a high voltage for ignition at a secondary coil of an ignition coil by interrupting flow of a current through a primary coil of the ignition coil by means of a switching element.

2. Description of the Background Art

Among conventional internal combustion engine ignition devices, there are such devices in which a time period for detecting an ion current is established by rendering conductive again the switching element connected to the primary coil of the ignition coil, after the interruption of electric flow of a primary current, to thereby cause a secondary current not to flow (for example, see, Patent Document 1).

Patent Document 1: Japanese Patent Application Laid-open No. 2010-121553

In the conventional ignition devices with the above described configuration, there is a problem in that since heat generation of the switching element becomes large when it is rendered conductive again after having been rendered conductive, it is required to suppress heat generation of the switching element itself and to ensure heat dissipation therefor, so that the devices are restricted in its upsizing and its coil-output characteristic.

SUMMARY OF THE INVENTION

The present invention has been made to solve the above problem, and an object thereof is to provide an internal combustion engine ignition device that suppresses heat generation of the switching element by reducing power loss related to the element and that enables a stable detection of the ion current, to thereby enhance reliability of the device and capability of the ignition system.

An internal combustion engine ignition device according to the invention comprises an ignition coil having a primary coil whose one end is connected to a power source terminal and a secondary coil whose one end is connected to an ignition plug; and a switching element which is serially connected to the other end of the primary coil and is ON/OFF controlled based on an ignition signal output from an ECU (Engine Control Unit) so as to cause or interrupt flow of a primary current through the primary coil of the ignition coil, said internal combustion engine ignition device further comprising: a secondary current detection circuit which is connected to the other end of the secondary coil, and, at the time of ignition when the switching element is made OFF, detects a secondary current flowing through the secondary coil to thereby output an output signal Vi2 during the secondary current exceeding a predetermined current threshold value Ith; an energy consumption circuit which is activated based on the output signal Vi2 from the secondary current detection circuit, to constitute a circuit for discharging energy stored in the ignition coil; and an ion current detection circuit which detects and outputs an ion current generated after the ignition.

According to the internal combustion engine ignition device of the invention, it is possible to achieve an internal combustion engine ignition device that suppresses heat generation of the switching element by reducing power loss related to the element and that enables a stable detection of the ion current, to thereby enhance reliability of the device and capability of the ignition system.

The foregoing and other objects, features, and advantages of the present invention will become more apparent from the following detailed description of the embodiments and the drawings.

DETAILED DESCRIPTION OF THE INVENTION

Figure 1:
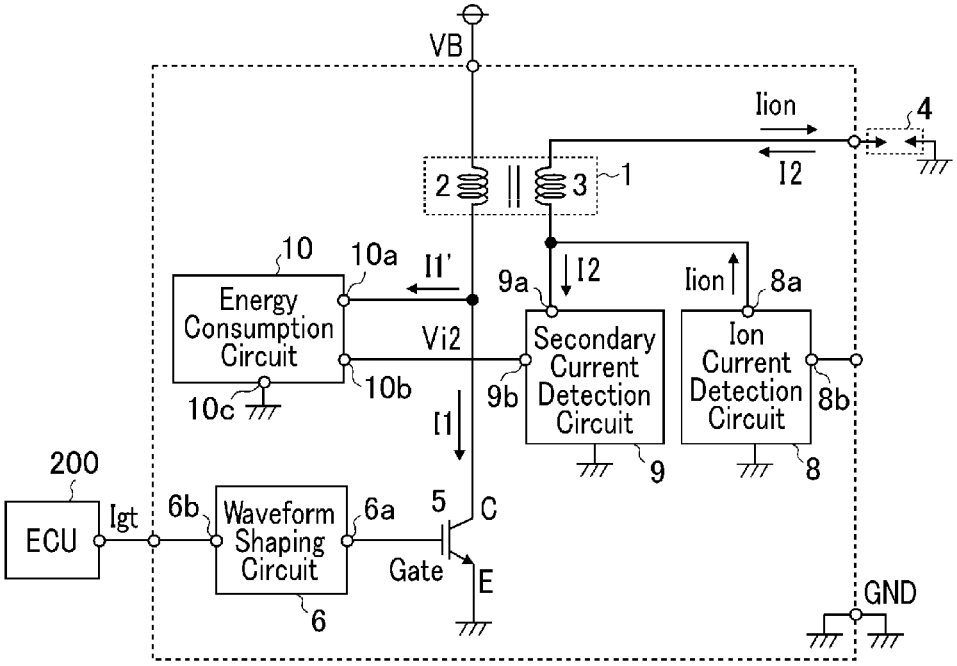
FIG. 1 is a circuit diagram showing a configuration of an internal combustion engine ignition device of Embodiment 1 of the invention.

Hereinafter, embodiments of the invention will be described with reference to the drawings. Note that, in the drawings, the same reference numerals represent the same or equivalent parts.

Embodiment 1

FIG. 1 is a circuit diagram showing a whole configuration of an internal combustion engine ignition device according to Embodiment 1 of the invention. In FIG. 1, the internal combustion engine ignition device of Embodiment 1 is an ignition device for an internal combustion engine mounted on a vehicle, and includes an engine control unit (ECU) 200 to be mounted in the vehicle, an ignition coil 1, a switching element 5, a waveform shaping circuit 6, an ion current detection circuit 8, a secondary current detection circuit 9 and an energy consumption circuit 10.

The ignition coil 1 has a primary coil 2 and a secondary coil 3, and is connected to a power source terminal VB, for example, of an in-vehicle battery. The voltage of the in-vehicle battery is 12 V, for example.

To a high-voltage side terminal that is one of the terminals of the secondary coil 3, an ignition plug 4 is connected. The ignition plug 4 is disposed in a combustion chamber of the internal combustion engine, and serves to ignite to burn a gasoline or like fuel supplied to the combustion chamber.

The waveform shaping circuit 6 is configured to include an output terminal 6*a* and an input terminal 6*b*. The output terminal 6*a* is connected to the latter-stage switching element 5. The switching element 5 is, for example, an IGBT (Insulated Gate Bipolar Transistor), whose gate terminal is connected to the output terminal 6*a* of the waveform shaping circuit 6, whose collector terminal C is connected to the primary coil 2 of the ignition coil 1, and whose emitter terminal E is connected to a reference potential point GND, such as a body of the vehicle. The reference potential point GND is generally called as earth.

A low-voltage side terminal that is the other terminal of the secondary coil 3 is connected to an input terminal 9*a* of the secondary current detection circuit 9 and an input terminal 8*a* of the ion current detection circuit 8. An output terminal 9*b* of the secondary current detection circuit 9 is connected to an input terminal 10*b* of the energy consumption circuit 10 to be described later, and an output terminal 10*a* of the energy consumption circuit 10 is connected to the primary coil 2 of the coil 1 and the collector of the switching element 5, while another output terminal 10*c* is connected to GND.

Figure 2:
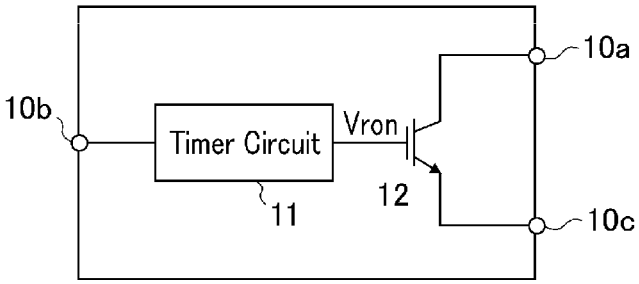
FIG. 2 is a circuit diagram showing an example of a configuration of an energy consumption circuit according to Embodiment 1 of the invention.

A detail of the energy consumption circuit 10 is shown in FIG. 2.

In FIG. 2, the input terminal 10*b* of the energy consumption circuit 10 is connected to a timer circuit 11, and an output terminal of the timer circuit 11 is connected to an input terminal of a second switching element 12 (here, a gate). One of output terminals of the second switching element 12 (here, a collector) is connected to the output terminal 10*a* of the energy consumption circuit 10, and the other output terminal of the second switching element 12 (here, an emitter) is connected to the output terminal 10*c* of the energy consumption circuit 10.

Figure 3:
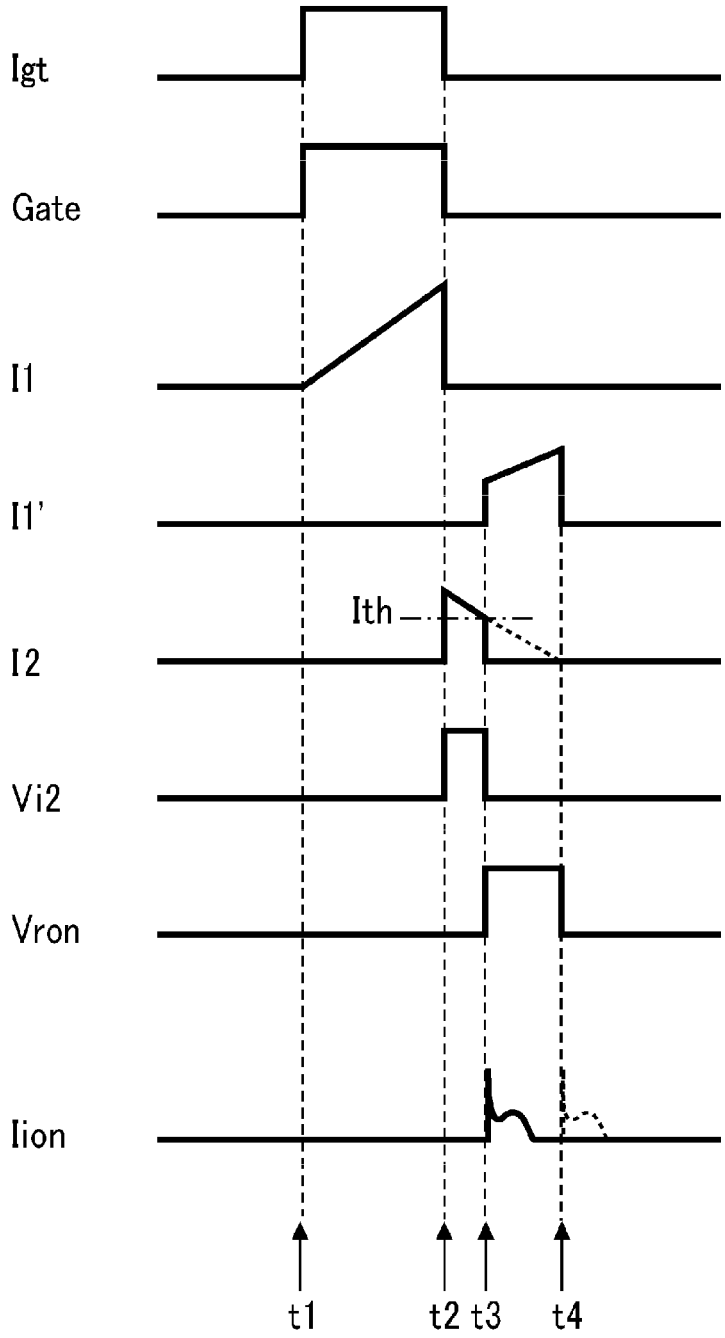
FIG. 3 is a timing chart showing signal waveforms from respective parts at respective operation points according to Embodiment 1 of the invention.

Next, a timing chart with respect to signal waveforms from the respective parts of Embodiment 1 is shown in FIG. 3.

In FIG. 3, when an ignition signal Igt is supplied at the time t1 from the microcomputer in the ECU 200 to the waveform shaping circuit 6 and the ignition signal Igt exceeds a reference voltage, its voltage is supplied to the input terminal of the switching element 5 (here, the gate) to thereby turn the switching element 5 to ON state, so that a primary current I1 begins to flow through the primary coil 2 of the ignition coil 1.

Thereafter, at the moment when the ignition signal Igt is turned to OFF state at the time t2 and thus becomes less than or equal to the reference voltage of the waveform shaping circuit 6 so that the input terminal voltage of the switching element 5 is turned OFF, the primary current I1 flowing through the primary coil 2 is interrupted, so that a high voltage is generated at the collector C of the switching element 5.

On this occasion, the energy of the primary coil 2 is transformed to the secondary coil 3, so that a negative voltage is induced at the high voltage side of the secondary coil 3. When the induced voltage of the secondary coil 3 exceeds a breakdown voltage across the gap of the ignition plug 4, a secondary current I2 flows through the secondary coil 3 and toward the secondary current detection circuit 9. If the secondary current I2 exceeds a current threshold value Ith having been set in the secondary current detection circuit 9, the secondary current detection circuit 9 outputs an output signal Vi2 to the energy consumption circuit 10.

At the time t3 when the secondary current I2 decreases to become lower than the current threshold value Ith, the output signal Vi2 is turned OFF. Using as a trigger the time when the output signal Vi2 of the secondary current detection circuit 9 is turned OFF, the timer circuit 11 in the energy consumption circuit 10 supplies an output signal Vron being set in a constant time period to the switching element 12, so that the energy consumption circuit 10 constitutes a circuit for discharging energy stored in the ignition coil 1 thereby causing a coil primary current I1' to flow until the time t4.

During this time period (t3 to t4), since the energy stored in the ignition coil 1 is consumed, the secondary current does not flow, and an ion current Iion flows from the ion current detection circuit 8 to the ignition plug 4 through the secondary coil 3.

According to the internal combustion engine ignition device of Embodiment 1 configured as described above, the energy stored in the ignition coil is discharged using the energy consumption circuit, it is possible to reduce power loss related to the switching element and suppress heat generation of the element, to thereby enhance the reliability.

Further, by making earlier the timing to detect the ion current using the secondary current detection circuit, it is possible to stably perform detection of the ion current, and thus to perform the control in a highly reliable manner.

Embodiment 2

Figure 4:
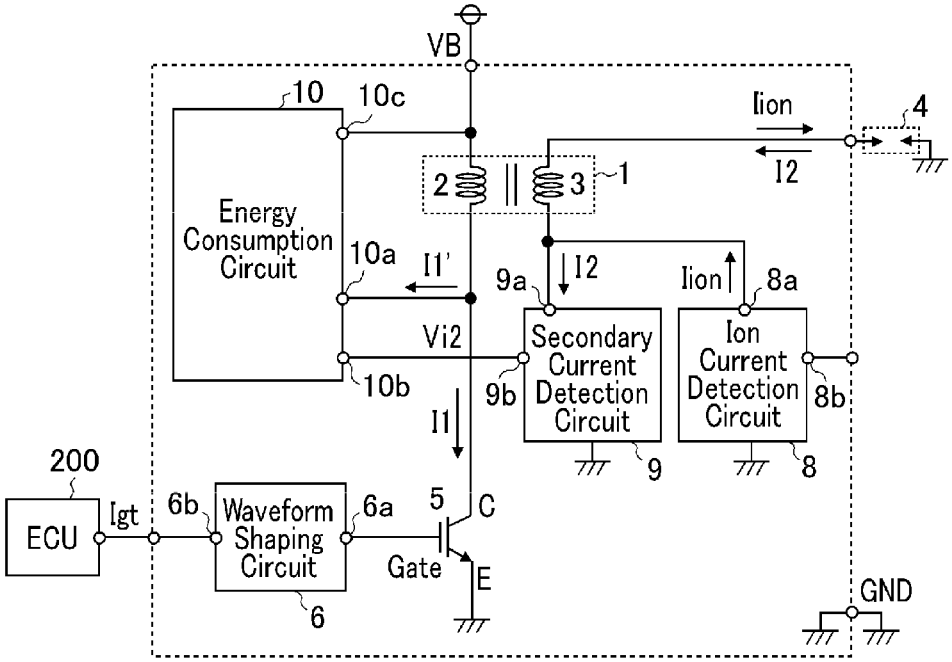
FIG. 4 is a circuit diagram showing a configuration of an internal combustion engine ignition device of Embodiment 2 of the invention.

FIG. 4 is a circuit diagram showing a whole configuration of an internal combustion engine ignition device of Embodiment 2 of the invention. In FIG. 4, the internal combustion engine ignition device of Embodiment 2 has a configuration corresponding to Embodiment 1 provided that the output terminal 10*c* of the energy consumption circuit 10 is connected to the power source terminal VB.

Since the other configuration is the same as that of Embodiment 1, the same reference numerals are given to the same parts, so that description therefor will be omitted. Further, although the timing chart similar to FIG. 3 is applied here, the current flowing from the power source terminal VB to the reference potential point (earth terminal) GND becomes smaller than that in Embodiment 1, and thus the current value of the coil primary current I1' becomes smaller.

According to the internal combustion engine ignition device of Embodiment 2 configured as described above, it is possible, in addition to providing similar effects in Embodiment 1, to reduce power loss related to the second switching element 12 because of connecting the output of the energy consumption circuit 10 to the power source terminal VB.

Embodiment 3

Figure 5:
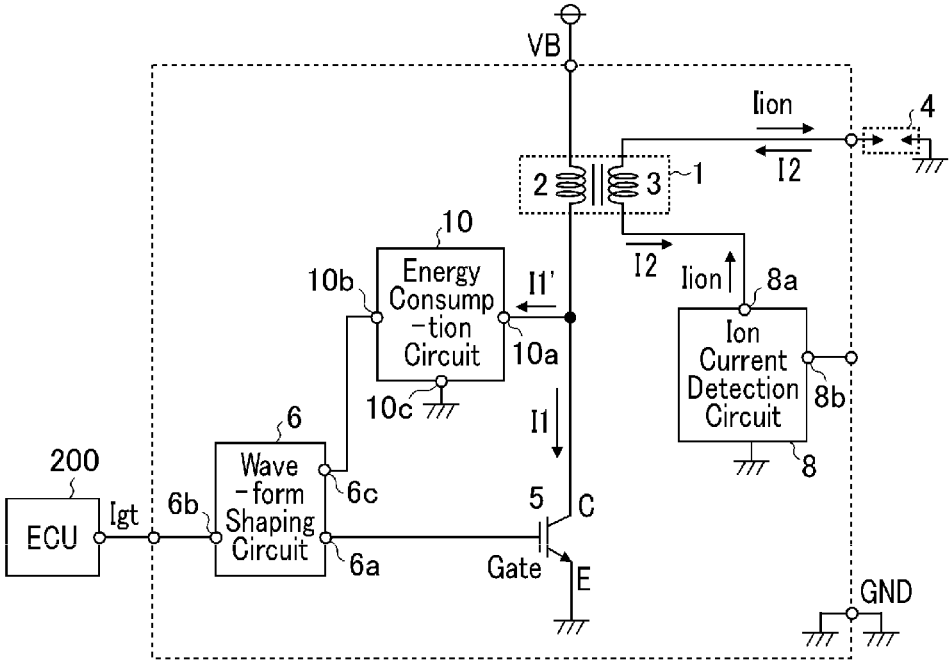
FIG. 5 is a circuit diagram showing a configuration of an internal combustion engine ignition device of Embodiment 3 of the invention.

FIG. 5 is a circuit diagram showing a whole configuration of an internal combustion engine ignition device of Embodiment 3 of the invention. In FIG. 5, the internal combustion engine ignition device of Embodiment 3 has a configuration corresponding to Embodiment 1 provided that the secondary current detection circuit 9 is eliminated, and instead, a second output terminal 6*c* is added to the waveform shaping circuit 6 so that the output signal from the waveform shaping circuit 6 is connected to the energy consumption circuit 10. Since the other configuration is the same as that of Embodiment 1, the same reference numerals are given to the same parts, so that description therefor will be omitted.

That is, the waveform shaping circuit 6 is set with a first threshold value Vth1 and a second threshold value Vth2, and outputs at the output terminal 6*a* a first signal to be supplied to the switching element 5, when the voltage at the input terminal 6*b* exceeds the first threshold value Vth1, and outputs at the output terminal 6*c* a second signal to be supplied to the energy consumption circuit 10, when the voltage at the input terminal 6*b* is more than or equal to the second threshold value Vth2 but is less than the first threshold value Vth1.

Figure 6:
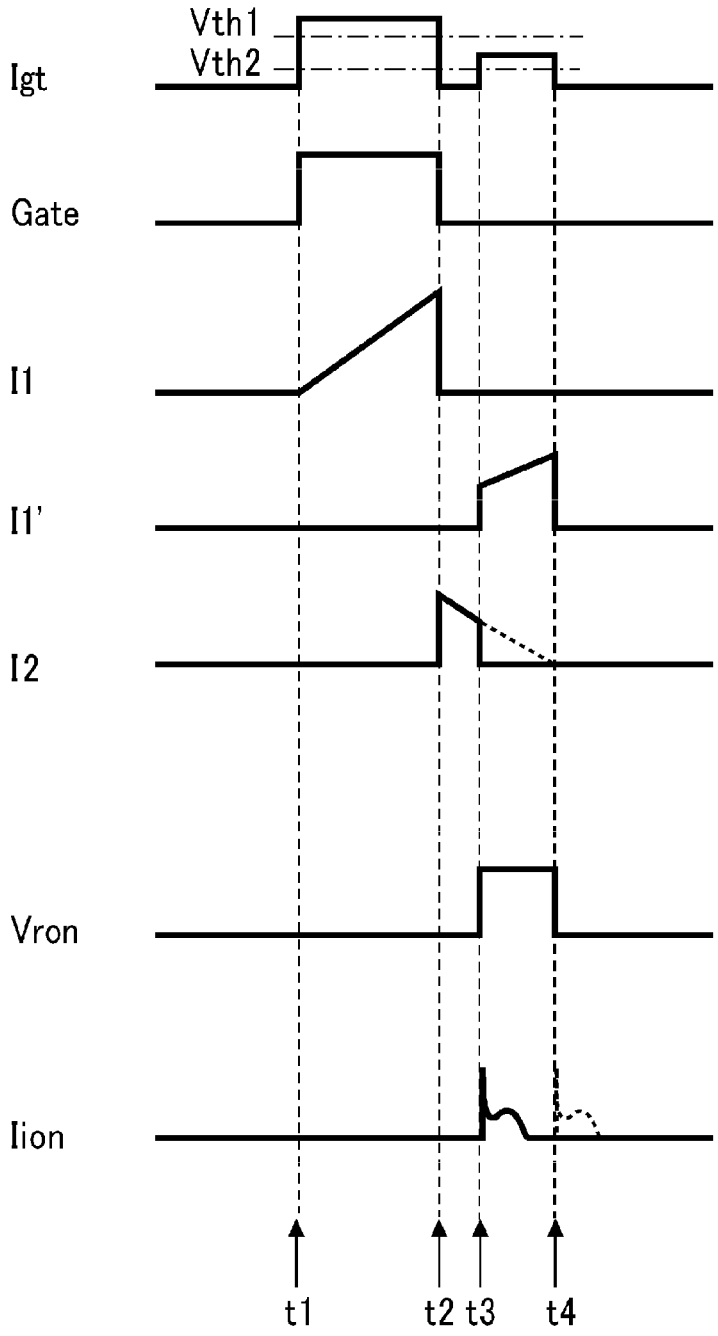
FIG. 6 is a timing chart showing signal waveforms from respective parts at respective operation points according to Embodiment 3 of the invention.

In FIG. 6, a timing chart showing signal waveforms from respective parts of Embodiment 3 is shown.

In FIG. 6, when an ignition signal Igt is supplied at the time t1 from the microcomputer in the ECU 200 to the waveform shaping circuit 6 and the ignition signal Igt exceeds the first threshold value Vth1 that is a first reference voltage, its voltage is supplied to the input terminal of the switching element 5 (here, the gate) to thereby turn the switching element 5 to ON state, so that a primary current I1 begins to flow through the primary coil 2 of the ignition coil 1.

Thereafter, at the moment when the ignition signal Igt is turned to OFF state at the time t2 and thus becomes less than or equal to the first reference voltage of the waveform shaping circuit 6 so that the input terminal voltage of the switching element 5 is turned OFF, the primary current I1 flowing through the primary coil 2 is interrupted, so that a high voltage is generated at the collector of the switching element 5.

On this occasion, the energy of the primary coil 2 is transformed to the secondary coil 3, so that a negative voltage is induced at the high voltage side of the secondary coil 3. When the induced voltage of the secondary coil 3 exceeds a breakdown voltage across the gap of the ignition plug 4, a secondary current I2 flows through the secondary coil 3. At this time, the ignition signal Igt is turned ON again, and when it exceeds the second threshold value Vth2, the waveform shaping circuit 6 supplies the second signal from the second output terminal 6*c* to the energy consumption circuit 10. During the input time period of the second signal, a drive signal Vron is supplied to the switching element 12, so that the energy consumption circuit 10 constitutes a circuit for discharging energy stored in the ignition coil 1 thereby causing a coil primary current I1' to flow until the time t4.

During this time period (t3 to t4), since the energy stored in the ignition coil 1 is consumed, the secondary current does not flow, and an ion current lion flows from the ion current detection circuit 8 to the ignition plug 4 through the secondary coil 3.

According to the internal combustion engine ignition device of Embodiment 3 configured as described above, because of controlling a time and a period for detecting the ion current on the basis of the ignition signal, it is possible to stably perform detection of the ion current, and thus to perform the control in a highly reliable manner.

Although the internal combustion engine ignition device according to the invention is used as an ignition device for an internal combustion engine mounted on a vehicle, it is also usable for an internal combustion engine mounted on a boat/ship, or an internal combustion engine used as a home-use or agricultural-use engine.

Various modifications and alternations of this invention will be apparent to those skilled in the art without departing from the scope and spirit of this invention, and it should be understood that this is not limited to the illustrative embodiments set forth herein.

What is claimed is:

1. An internal combustion engine ignition device which comprises an ignition coil having a primary coil whose one end is connected to a power source terminal and a secondary coil whose one end is connected to an ignition plug; and a switching element which is serially connected to the other end of the primary coil and is ON/OFF controlled based on an ignition signal output from an ECU (Engine Control Unit) so as to cause or interrupt flow of a primary current through the primary coil of the ignition coil, said internal combustion engine ignition device comprising:

a secondary current detection circuit which is connected to the other end of the secondary coil, and, at the time of ignition when the switching element is made OFF, detects a secondary current flowing through the secondary coil to thereby output an output signal Vi2 during the secondary current exceeding a predetermined current threshold value Ith;

an energy consumption circuit which is activated based on the output signal Vi2 from the secondary current detection circuit, to constitute a circuit for discharging energy stored in the ignition coil; and an ion current detection circuit which detects and outputs an ion current generated after the ignition.

2. An internal combustion engine ignition device which comprises an ignition coil having a primary coil whose one end is connected to a power source terminal and a secondary coil whose one end is connected to an ignition plug; and a switching element which is serially connected to the other end of the primary coil and is ON/OFF controlled based on an ignition signal output from an ECU (Engine Control Unit) so as to cause or interrupt flow of a primary current through the primary coil of the ignition coil, said internal combustion engine ignition device comprising:

a waveform shaping circuit in which a first threshold value Vth1 and a second threshold value Vth2 are set, to which the ignition signal from the ECU is input, and which comprises a first output terminal for supplying a first signal to the switching element when the ignition signal exceeds the first threshold value Vth1, and a second output terminal for outputting a second signal when the ignition signal is more than or equal to the second threshold value Vth2 but is less than the first threshold value Vth1;

an energy consumption circuit which is activated based on the second signal from the second output terminal, to constitute a circuit for discharging energy stored in the ignition coil; and an ion current detection circuit which detects and outputs an ion current generated after the ignition.

3. The internal combustion engine ignition device of claim 1, wherein the energy consumption circuit starts its operation from when the secondary current detected by the secondary current detection circuit becomes a set value or less, to constitute the circuit for discharging the energy.

4. The internal combustion engine ignition device of claim 1, wherein the energy consumption circuit is configured with a second switching element whose one end is connected to a serial connection point in between the primary coil and the aforesaid switching element, and whose other end is connected to a ground potential.

5. The internal combustion engine ignition device of claim 2, wherein the energy consumption circuit is configured with a second switching element whose one end is connected to a serial connection point in between the primary coil and the aforesaid switching element, and whose other end is connected to a ground potential.

6. The internal combustion engine ignition device of claim 1, wherein the energy consumption circuit is configured with a second switching element whose output terminals are connected to both ends of the primary coil.

7. The internal combustion engine ignition device of claim 2, wherein the energy consumption circuit is configured with a second switching element whose output terminals are connected to both ends of the primary coil.

* * * * *